US006202575B1

(12) United States Patent
Bauver, II et al.

(10) Patent No.: US 6,202,575 B1
(45) Date of Patent: Mar. 20, 2001

(54) CORNER WINDBOX OVERFIRE AIR COMPARTMENT FOR A FOSSIL FUEL-FIRED FURNACE

(75) Inventors: Wesley P. Bauver, II, Granville, MA (US); Richard C. LaFlesh, Suffield, CT (US); John C. Lewis, Feeding Hills, MA (US); Robert D. Lewis, Cromwell, CT (US)

(73) Assignee: ABB Alstom Power Inc., Windsor, CT (US)

( * ) Notice: Subject to any disclaimer, the term of this patent is extended or adjusted under 35 U.S.C. 154(b) by 0 days.

(21) Appl. No.: 09/252,155

(22) Filed: Feb. 18, 1999

(51) Int. Cl.[7] ..... F23L 9/00

(52) U.S. Cl. ..... 110/297; 110/348; 431/10; 239/587

(58) Field of Search ..... 110/297, 308, 110/309, 313, 348, 147, 182.5; 431/10; 239/587, 591, 600

(56) References Cited

U.S. PATENT DOCUMENTS 1,711,943 * 5/1929 Higinbotham ..... 110/348 X
4,425,855 * 1/1984 Chadshay ..... 110/347
4,520,739 * 6/1985 McCartney et al. ..... 239/587 X
5,020,454 * 6/1991 Hellewell et al. ..... 110/297 X
5,662,464 * 9/1997 LaRose et al. ..... 431/10 X
5,746,143 * 5/1998 Vatsky ..... 110/297
5,824,275 * 10/1998 Bitzer et al. ..... 110/297 X

* cited by examiner

*Primary Examiner*—Ira S. Lazarus
*Assistant Examiner*—Ljiljana V. Ciric
(74) *Attorney, Agent, or Firm*—Russell W. Warnock

(57) ABSTRACT

An air compartment of a corner windbox of a tangential firing system of a fossil fuel-fired furnace for injecting secondary air into the furnace. The air compartment includes a channel portion with an entrance end communicating with an air delivery duct and an exit end communicating via an exit assembly with the furnace opening. The exit assembly includes at least one vane for guiding an air stream and a mounting frame for supporting the vane relative to the channel portion for guiding thereby of an air stream passing from the channel portion through the furnace opening into the furnace. The vane includes a surface portion which intersects the horizontal plane at an acute angle and a pair of opposed transverse edges. The vane and the mounting frame are disposed within the channel portion such that the leading edge of the vane is upstream of the furnace opening.

12 Claims, 5 Drawing Sheets

CORNER WINDBOX OVERFIRE AIR COMPARTMENT FOR A FOSSIL FUEL-FIRED FURNACE

BACKGROUND OF THE INVENTION

The present invention relates to a corner windbox air compartment of a fossil fuel-fired furnace equipped with a tangential firing system and an exit assembly for such an air compartment.

It is known that a staged combustion approach can improve the reduction of $NO_X$ in a fossil fuel-fired furnace such as, for example, a furnace in which pulverized coal is fired. Such a staged combustion approach may include reducing the quantity of air introduced into a main burner region of the furnace, which is a region in which the fuel such as the pulverized coal is injected, and instead introducing greater quantities of air above the main burner zone.

Over the years, there have been different approaches pursued in the prior art insofar as concerns addressing the need to limit emissions of the $NO_X$ that is created as a consequence of the combustion of fossil fuels in furnaces. The focus of one such approach has been on developing so-called low $NO_X$ firing systems suitable for employment in fossil fuel-fired furnaces. U.S. Pat. No. 5,020,454 entitled "Clustered Concentric Tangential Firing System", which issued on Jun. 4, 1991 and which is assigned to the same assignee as the present patent application discloses an example of one such low $NO_X$ firing system. In accordance with the teachings of U.S. Pat. No. 5,020,454, a clustered concentric tangential firing system is provided that includes a windbox, a first cluster of fuel nozzles mounted in the windbox and operative for injecting clustered fuel into the furnace so as to create a first fuel-rich zone therewithin, a second cluster of fuel nozzles mounted in the windbox and operative for injecting clustered fuel into the furnace so as to create a second fuel-rich zone therewithin, an offset air nozzle mounted in the windbox and operative for injecting offset air into the furnace such that the offset air is directed away from the clustered fuel injected into the furnace and towards the walls of the furnace, a close-coupled overfire air nozzle mounted in the windbox and operative for injecting close-coupled overfire air into the furnace, and a separated overfire air nozzle mounted in the windbox and operative for injecting separated overfire air into the furnace.

Another example of such a low $NO_X$ firing system is that which forms the subject matter of U.S. Pat. No. 5,315,939 entitled "Integrated Low $NO_X$ Tangential Firing System", which issued on May 31, 1994 and which is assigned to the same assignee as the present patent application. In accordance with the teachings of U.S. Pat. No. 5,315,939, an integrated low $NO_X$ tangential firing system is provided that includes pulverized solid fuel supply means, flame attachment pulverized solid fuel nozzle tips, concentric firing nozzles, close-coupled overfire air, and multi-staged separate overfire air and when employed with a pulverized solid fuel-fired furnace is capable of limiting $NO_X$ emissions therefrom to less than 0.15 lb./million BTU while yet maintaining carbon-in-flyash to less than 5% and CO emissions to less than 50 ppm.

Both of the tangentially fired furnaces disclosed in the two afore-mentioned references capitalize on the knowledge that the formation of $NO_X$ in a tangentially fired furnace can frequently be minimized by judicious control of the air introduced above the fuel-rich main burner zone—i.e. the introduction of so-called overfire air. Judicious control of the overfire air in such circumstances is characterized by the introduction of the overfire air in a manner which supports the formation of the swirling fireball in the furnace while also supporting the sub-stoichiometric conditions in the main burner zone. With regard to supporting the sub-stoichiometric conditions in the main burner zone, it can be appreciated that any increase in the residence time of the fuel in the sub-stoichiometric (fuel rich) main burner zone will further promote the reduction of $NO_X$.

Notwithstanding the fact that over the years there have been different approaches disclosed in the prior art targeted at the reduction of emissions of the $NO_X$ that is created as a consequence of the combustion of fossil fuels in furnaces, a need still exists in the prior art to improve upon what has been accomplished in the pursuance of these different approaches. For example, the need still exists for an approach which would permit the introduction of overfire air in a manner which promotes a longer residence time of fuel in the sub-stoichiometric conditions of the main burner zone of a tangentially fired furnace while at the same time minimizing the energy required to accomplish an introduction of overfire air in this manner.

SUMMARY OF THE INVENTION

It is one object of the present invention to provide an air compartment for a corner windbox of a tangentially fired furnace which permits the introduction of overfire air in a manner which promotes a longer residence time of fuel in the sub-stoichiometric conditions of the main burner zone of the furnace while at the same time minimizing the energy required to accomplish an introduction of overfire air in this manner.

It is another object of the present invention to provide an exit assembly for an air compartment of a corner windbox of a tangentially fired furnace which permits the introduction of overfire air in a manner which promotes a longer residence time of fuel in the sub-stoichiometric conditions of the main burner zone of the furnace while at the same time minimizing the energy required to accomplish an introduction of overfire air in this manner.

In accordance with one aspect of the present invention, there is provided an air compartment of a corner windbox of a tangential firing system of a fossil fuel-fired furnace which permits the introduction of overfire air in a manner which promotes a longer residence time of fuel in the sub-stoichiometric conditions of the main burner zone of the furnace while at the same time minimizing the energy required to accomplish an introduction of overfire air in this manner. The air compartment includes a channel portion for the flow therethrough of air from an air delivery duct to an opening in the furnace and an exit assembly. The channel portion has a longitudinal extent with an entrance end communicating with the air delivery duct and an exit end communicating with the furnace opening. Also, the channel includes a generally parallelepiped cross sectional shape transverse to its longitudinal extent. The channel portion is mounted in the corner windbox such that its longitudinal extent is parallel to a horizontal plane.

The exit assembly includes a first means for guiding an air stream at the exit end of the channel portion and means for mounting the first air stream guiding means relative to the channel portion for guiding thereby of an air stream passing from the channel portion through the furnace opening into the furnace. The first air stream guiding means includes a surface portion which intersects the horizontal plane at an acute angle and a pair of opposed transverse edges. The mounting means includes a pair of opposed side portions and means for securing each opposed side portion interiorly of the channel portion on a respective side thereof, the first air stream guiding means extending between the pair of opposed side portions with each transverse edge of the first air stream guiding means being secured to a respective one of the opposed side portions of the mounting means. The mounting means and the first air stream guiding means are disposed within the channel portion such that the leading edge of the first air stream guiding means is upstream of the furnace opening.

According to one feature of the one aspect of the present invention, the mounting means includes an interconnecting portion secured to and extending transversely between the pair of opposed side portions at a vertical spacing from the first air stream guiding means.

According to a further feature of the one aspect of the present invention, there is provided a second air stream guiding means having opposed transverse edges each secured to a respective one of the pair of opposed side portions of the mounting means such that the second air stream guiding means is secured to and extends between the opposed side portions of the mounting means at a disposition above the first air stream guiding means with longitudinally coextensive portions of the first and second air stream guiding means being generally parallel to one another.

In one configuration of the further feature of the one aspect of the present invention, the upwardly oriented surface portion of the first air stream guiding means includes an upstream longitudinal extent having a predetermined radius of curvature and a downstream longitudinal extent having a predetermined radius of curvature different than the radius of curvature of the upstream longitudinal extent.

According to an additional feature of the one aspect of the present invention, the air compartment exit assembly includes support means extending vertically between and secured to the first and second air guiding means. According to still another feature of the one aspect of the present invention, the air compartment exit assembly includes a pair of securement pins each insertable through a throughbore respectively disposed in each of the opposed side portions of the air compartment exit assembly into engagement with an engagement bore respectively disposed in each side of the channel portion.

Still an additional further feature of the one aspect of the present invention is the feature wherein the air compartment exit assembly includes a second air guiding means at a disposition above the first air stream guiding means and, additionally, there is provided means for movably adjusting the orientation of the first air guiding means relative to the horizontal plane such that the first air guiding means can be adjustably moved between a first position in which longitudinally coextensive portions of the first and second air stream guiding means are generally parallel to one another and a second position in which longitudinally coextensive portions of the first and second air stream guiding means are not parallel to one another.

In accordance with another aspect of the present invention, an exit assembly is provided for an air compartment of a corner windbox of a tangential firing system of a fossil fuel-fired furnace which permits the introduction of overfire air in a manner which promotes a longer residence time of fuel in the sub-stoichiometric conditions of the main burner zone of the furnace while at the same time minimizing the energy required to accomplish an introduction of overfire air in this manner. The air compartment exit assembly includes a first means for guiding an air stream at the exit end of the channel portion of the air compartment and means for mounting the first air stream guiding means relative to the channel portion for guiding thereby of an air stream passing from the channel portion through the furnace opening into the furnace.

The first air stream guiding means has a surface portion which intersects the horizontal plane at an acute angle and, additionally, the first air stream guiding means has a pair of opposed transverse edges.

The mounting means of the exit assembly includes a pair of opposed side portions and means for securing each opposed side portion interiorly of the channel portion on a respective side thereof, the first air stream guiding means extending between the pair of opposed side portions with each transverse edge of the first air stream guiding means being secured to a respective one of the opposed side portions of the mounting means and the mounting means. The first air stream guiding means is disposed within the channel portion of the air compartment such that the leading edge of the first air stream guiding means is upstream of the furnace opening.

DETAILED DESCRIPTION OF THE PREFERRED EMBODIMENTS

As seen in FIGS. 1–4, in accordance with the present invention, one embodiment of an improved air compartment is illustrated for a tangential firing system of a fossil fuel-fired furnace. The fossil fuel-fired furnace has a plurality of walls embodying therewithin a burner region in which a combustion process is sustained by a tangential firing system. The improvement relates to an air compartment of a windbox of the furnace or, if desired, a plurality of air compartments in a plurality of windboxes, and an exemplary embodiment of the improved air compartment embodying the novel air compartment exit assembly of the present invention will be described in more detail hereafter.

Figure 1:
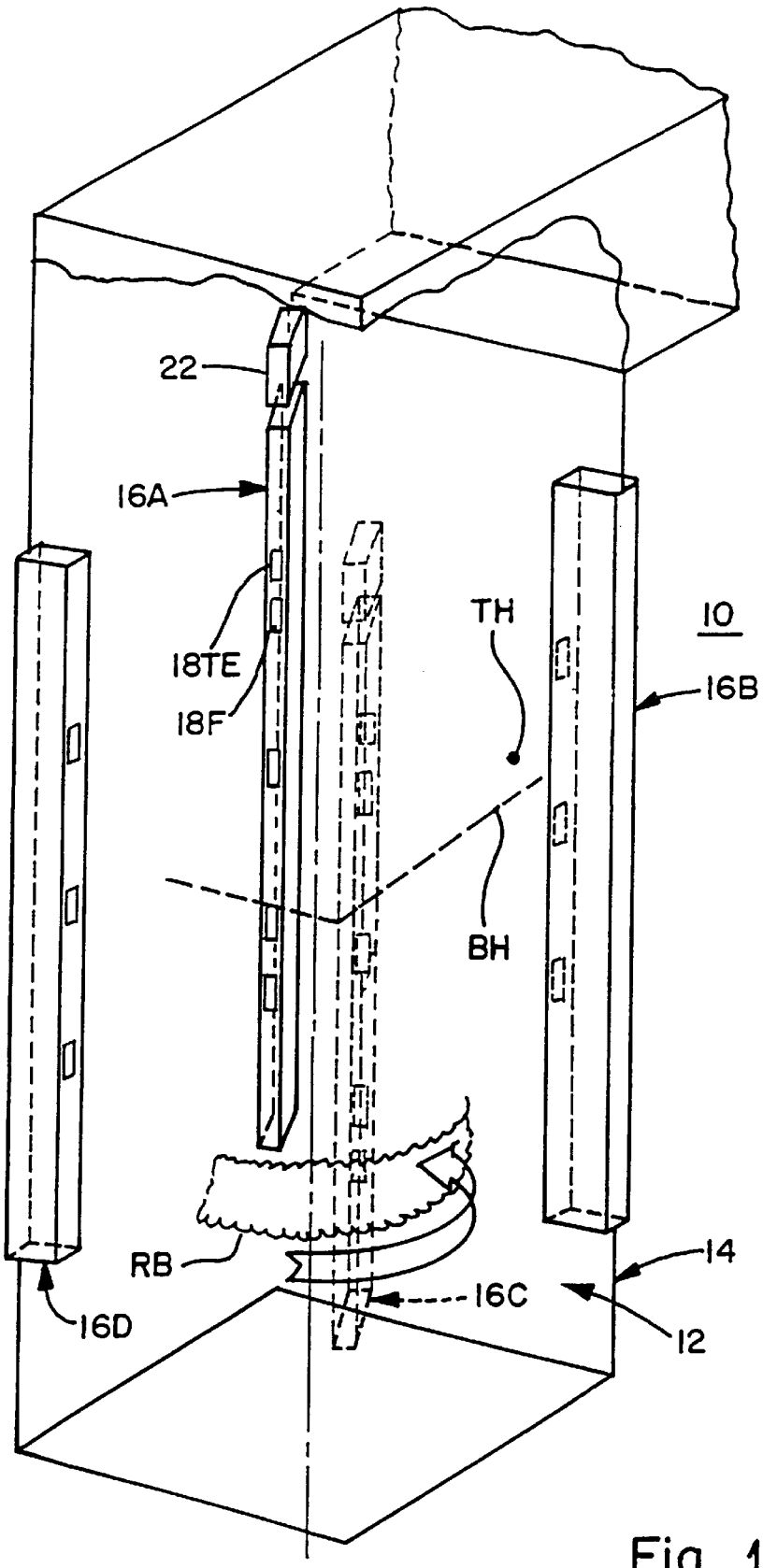
FIG. 1 is a schematic perspective view of a fossil fuel-fired furnace equipped with a tangential firing system and having one embodiment of the corner windbox air compartment of the present invention.

The tangential firing system of the furnace is preferably of the type commonly denominated as a concentric tangential firing system. The concentric tangential firing system, generally designated as 10 in FIG. 1, is operable in a burner region 12 of a fossil fuel-fired furnace 14, which may be a pulverized coal-fired furnace. The burner region 12 defines a longitudinal axis BL extending vertically through the center of the burner region.

The burner region 12 has four corners each substantially equidistant from adjacent corners such a combustion chamber thus formed by the burner region 12 has a parallelepiped shape which may be, for example, a rectangular or square shape. The burner region 12 shown in FIG. 1 has a square cross section. In the four corners of the combustion chamber are arranged a first windbox 16A, a second windbox 16B, a third windbox 16C, and a fourth windbox 16D. The first windbox 16A is generally circumferentially intermediately disposed between the second windbox 16B and the fourth windbox 16D as viewed in a circumferential direction relative to the burner region longitudinal axis BL such that the first windbox 16A is at a generally equal circumferential spacing from each respective one of the second windbox 16B and the fourth windbox 16D. The third windbox 16C is generally circumferentially intermediately disposed between the second windbox 16B and the fourth windbox 16D on the respective other side of these windboxes as viewed in the circumferential direction such that the third windbox 16C is at a generally equal circumferential spacing from each respective one of the second windbox 16B and the fourth windbox 16D.

The first windbox 16A and the third windbox 16C define a first pair of juxtaposed windboxes in juxtaposed relation to one another (i.e., the pair of windboxes are disposed on a diagonal DD passing through the longitudinal axis BL). The second windbox 16B and the fourth windbox 16D define a second pair of juxtaposed windboxes in juxtaposed relation to one another.

The windboxes 16A–16D each comprise a plurality of compartments which will now be described in greater detail with respect to the first windbox 16A, which is hereby designated for this descriptive purpose as a representative windbox, it being understood that the other windboxes 16B, 16C, and 16D are identical in configuration and operation to this representative windbox. The first windbox 16A includes a series of lower compartments 18 each for introducing therethrough fuel, air, or both fuel and air such that a combination of air and fuel is introduced into the combustion chamber via this series of lower compartments. It is to be understood, however, that one or more of the windboxes 16A–16D can alternatively be configured such that its series of lower compartments only introduce a selected one of fuel or air into the burner region 12, as desired. The lower series of compartments 18 extend into the bottom half BH of the furnace 14 in a vertical arrangement with the series of lower compartments 18 being successively located one below another in an extent from a topmost one of the lower compartments, designated the top end lower compartment 18TE, to a bottommost one of the lower compartments.

Figure 2:
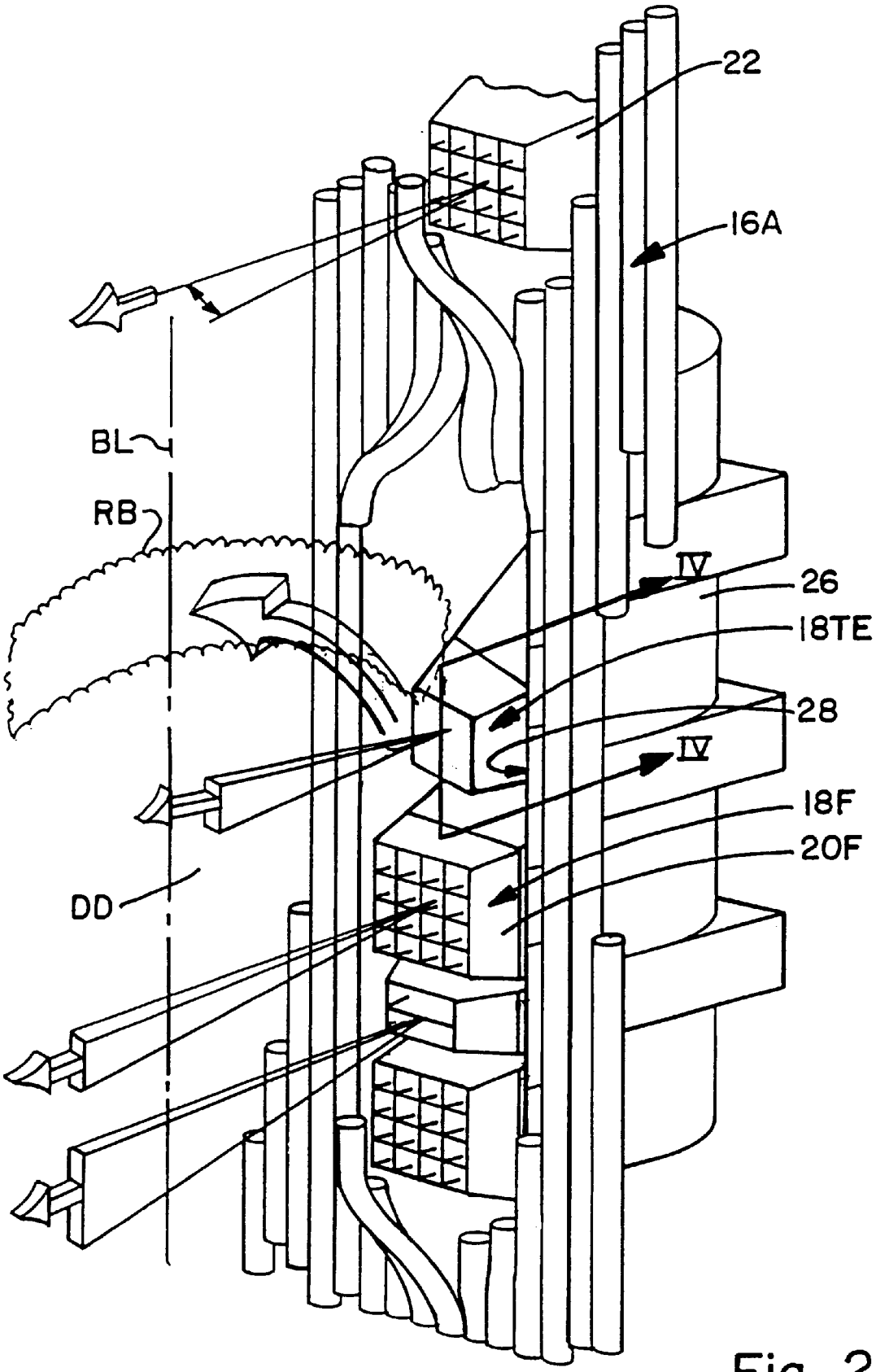
FIG. 2 is an enlarged perspective view of one of the corner windboxes of the fossil fuel-fired furnace shown in FIG. 1 and illustrating the one embodiment of the corner windbox air compartment of the present invention.

The first windbox 16A further includes a plurality of fuel nozzles 20 each suitably mounted in selected ones of the lower compartments 18 for tangentially firing fuel into the combustion chamber. As seen in FIG. 2, one of the fuel nozzles 20 is representatively shown in its mounted disposition in a representative one of the lower compartments 18 of the type provided with a fuel nozzle, this representative compartment being hereinafter designated as the lower compartment 18F. The fuel nozzle 20 disposed in the lower compartment 18F fires fuel and primary air in a direction tangential to a fireball RB that rotates or swirls generally about the longitudinal axis BL of the burner region 12 while flowing upwardly therein.

The first windbox 16A further includes a plurality of air nozzles 22 each for introducing secondary air from other ones of the lower compartments 18 into the combustion chamber tangential to the rotating fireball RB. The top end lower compartment 18TE is one of the respective lower compartments 18 dedicated to introducing secondary air into the furnace 14 and, as will be described shortly, this compartment, in accordance with the present invention, is operable to introduce secondary air into the burner region 12 in a manner advantageous to the minimization of $NO_X$ formation. The air collectively introduced via both the primary air nozzle portions of the fuel nozzles 20 and the secondary air nozzles 22 mounted in the lower compartments 18 is in an amount less than the amount required for complete combustion of the fuel fired into the burner region 12 such that the portion of the burner region 12 associated with the lower compartments 18 is characterized by a sub-stoichiometric combustion condition.

The furnace 14 additionally includes a separated overfire air compartment 22 which is disposed at a vertical spacing from the top end lower compartment 18TE greater than the vertical spacing between any given pair of adjacent lower compartments 18. The separated overfire air compartment 22 is operable to introduce air into an upper region of the furnace 14 above the burner region 12, as will be described in more detail later. However, it is to understood that the improved air compartment of the present invention can be installed and operated as well in a furnace which is not equipped with a separated overfire air compartment.

Figure 4:
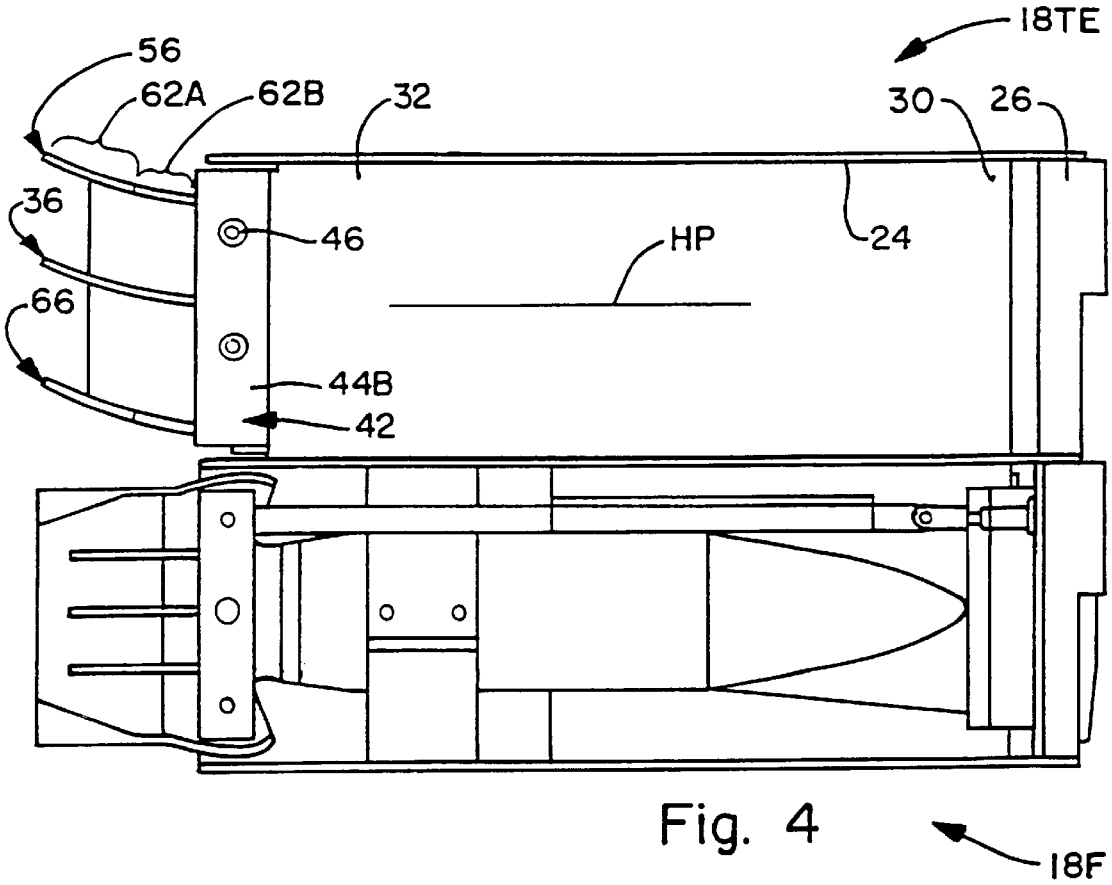
FIG. 4 is a side elevational view, in partial vertical section, of the one embodiment of the corner windbox air compartment of the present invention shown in FIGS. 1–3 and taken along Line IV—IV in FIG. 2.
Figure 3:
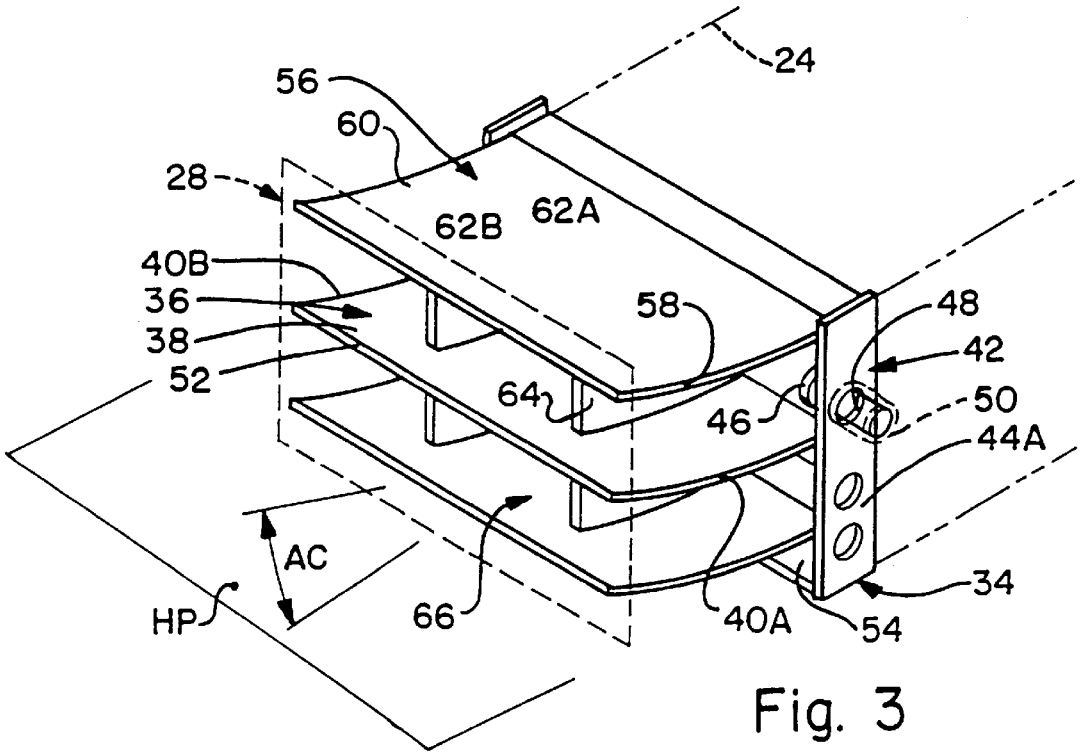
FIG. 3 is an enlarged perspective view of the one embodiment of the corner windbox air compartment of the present invention shown in FIGS. 1 and 2.

With reference now to FIG. 3, which is an enlarged perspective view of the top end lower compartment 18TE, and to FIG. 4, which is a side elevational view of the top end lower compartment 18TE and the adjacent lower compartment 18F, further details of this top end air compartment 18TE will now be described. The improved air compartment of the present invention can be provided in any suitable one of the lower air compartments or in any suitable one of the separated overfire air compartments of a corner windbox. For example, the improved air compartment may be provided in one of the air compartments near or at the top end of the series of the lower compartments 18 such as, for example, the top end lower compartment 18TE or one or more of the other lower compartments.

For purposes of further describing the improved air compartment of the present invention, reference will now be had to the top end lower compartment 18TE as a representative air compartment capable of being configured as the improved air compartment of the present invention. The top end lower compartment 18TE includes a channel portion 24 for the flow therethrough of secondary air from an air delivery duct 26 to an opening 28 in the furnace 14. The channel portion 24 has a longitudinal extent with an entrance end 30 communicating with the air delivery duct 26 and an exit end 32 communicating with the furnace opening 28. The channel portion 24 of the top end lower compartment 18TE has a generally parallelepiped cross sectional shape transverse to its longitudinal extent and is mounted in the first windbox 16A such that its longitudinal extent is parallel to a horizontal plane HP.

The top end lower compartment 18TE also includes an air compartment exit assembly 34 having a first means for guiding an air stream at the exit end of the channel portion in the form of a first vane 36 having a surface portion 38 which intersects the horizontal plane HP at an acute angle AC. The first vane 36 has a pair of opposed transverse edges 40A, 40B. The air compartment exit assembly 34 also includes means for mounting the first air stream guiding means relative to the channel portion 24 for guiding thereby of an air stream passing from the channel portion 24 through the furnace opening 28 into the furnace 14. The mounting means, in the preferred embodiment of the present invention, is preferably in the form of a mounting frame 42 having a pair of opposed side portions 44A, 44B to which the first vane 36 is fixedly secured by weldment or another suitable fixed securement and means for securing the mounting frame 42 interiorly of the channel portion 24 with each opposed side portion 44A, 44B of the mounting frame on a respective side of the channel portion 24. The securing means preferably includes a pair of securement pins 46 each insertable through a throughbore 48 respectively disposed in one of the opposed side portions 44A, 44B of the mounting frame 42 into engagement with an engagement bore 50 respectively disposed in each side of the channel portion 24. The first vane 36 thus extends between the pair of opposed side portions 44A, 44B with each transverse edge 40A, 40B of the vane being secured to a respective one of the opposed side portions 44A, 44B of the mounting frame 42. The mounting frame 42 and the first vane 36 are disposed within the channel portion 24 such that the leading edge 52 of the first vane 36 is upstream of the furnace opening 28. In some operational conditions, the thickness of the first vane 36 may be of such a substantial magnitude that the pressure loss characteristics of the vane are not fully optimized and it may then be preferable that the leading edge 52 is chamfered to assist in reducing the pressure loss.

The mounting frame 42 also includes an interconnecting portion 54 secured to and extending transversely between the pair of opposed side portions 44A, 44B at a vertical spacing below the first vane 36. The mounting frame 42 is preferably configured with a parallelepiped cross sectional shape having one pair of opposed parallel sides formed by the opposed side portions 44A, 44B and another pair of opposed parallel sides formed by the interconnecting portion 54 and another interconnecting portion secured to and extending transversely between the pair of opposed side portions 44A, 44B parallel to the interconnecting portion 54.

The air compartment exit assembly 34 further includes a second air stream guiding means in the form of a second vane 56 having opposed transverse edges 58A, 58B each secured to a respective one of the pair of opposed side portions 44A, 44B of the mounting frame 42 such that the second vane 56 is secured to and extends between the opposed side portions 44A, 44B of the mounting frame 42 at a complementary disposition above the first vane 36 with longitudinally coextensive portions of the first vane 36 and the second vane 56 being generally parallel to one another. An upwardly oriented surface portion 60 of the first vane 36 includes an upstream longitudinal extent 62A having a predetermined radius of curvature and a downstream longitudinal extent 62B having a predetermined radius of curvature different than the radius of curvature of the upstream longitudinal extent 62A.

Support means in the form of a plurality of ribs 64 are preferably provided which extend vertically between, and are secured, to the first vane 36 and the second vane 56. The air compartment exit assembly 34 additionally includes, in the version of the top end air compartment 18TE shown in FIGS. 3 and 4, a third vane 66 secured to the mounting frame 42 below the first vane 36 and extending in complementary disposition thereto with longitudinally coextensive portions of the first vane 36 and the third vane 66 being generally parallel to one another.

Figure 6:
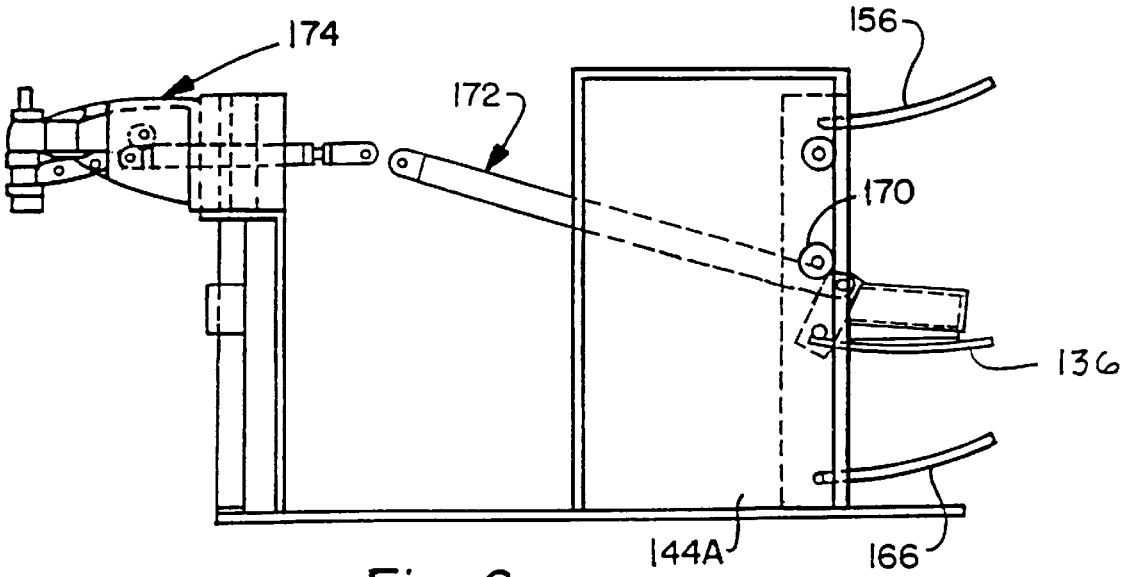
FIG. 6 is a side elevational view of the another embodiment of the corner windbox air compartment of the present invention shown in FIG. 5.
Figure 5:
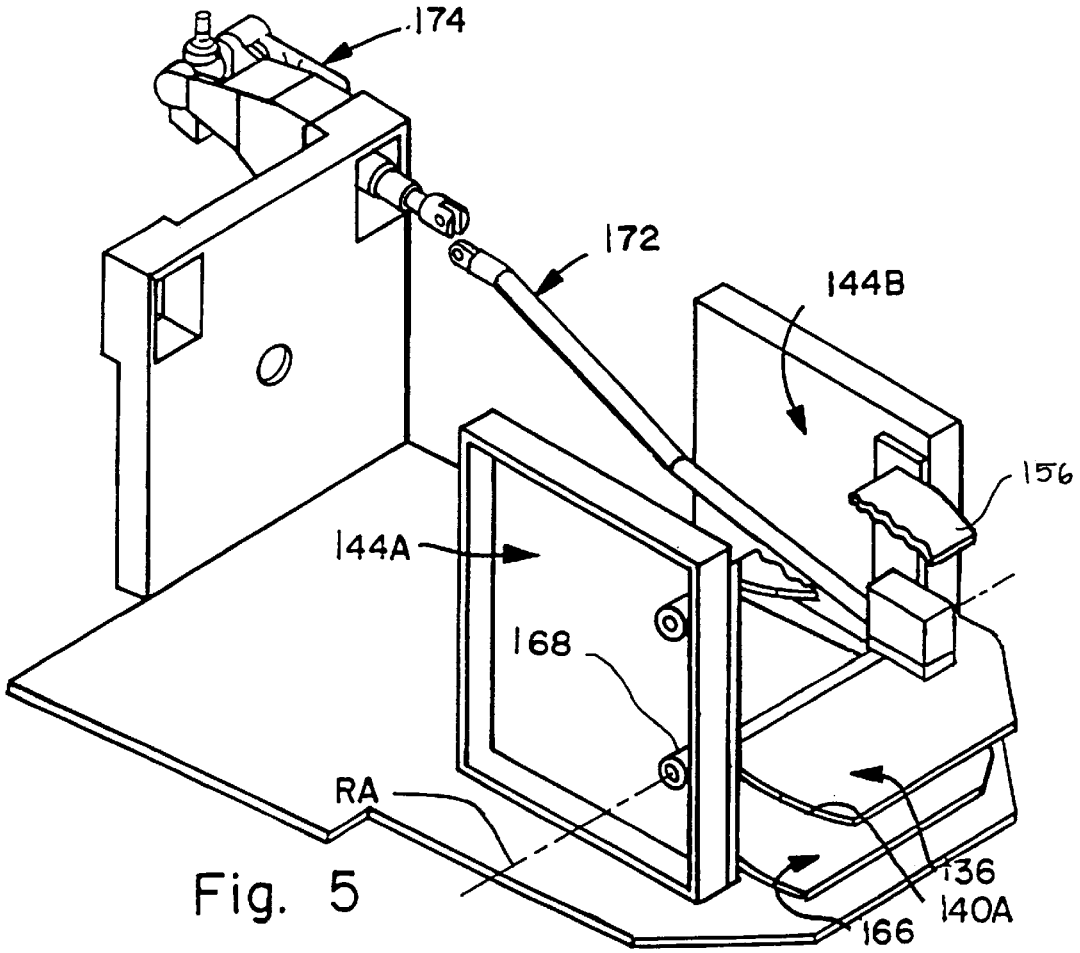
FIG. 5 is a schematic perspective view of another embodiment of the corner windbox air compartment of the present invention installable in a fossil fuel-fired furnace equipped with a tangential firing system.

In FIGS. 5 and 6, another embodiment of the top end air compartment of the present invention for a corner windbox of a fossil fuel-fired furnace equipped with a tangential firing system is illustrated. The another embodiment of the top end air compartment includes a channel portion (not shown) identical to the channel portion of the one embodiment of the top end air compartment described with respect to FIGS. 1–4 and components of this another embodiment of the top end air compartment are hereinafter designated with hundred ("100") series reference numbers corresponding to the reference numbers of like components of the one embodiment. The another embodiment of the top end air compartment shown in FIGS. 5 and 6 includes an air compartment exit assembly, generally designated as 134, which is configured identically to the exit assembly 34 of the one embodiment of the top end air except that, in lieu of the fixedly mounted first vane 36 of the one embodiment of the top end air compartment, the air compartment exit assembly 134 includes means for movably adjusting the orientation of the first air guiding means so as to vary the angle AC defined by a first vane 136 and the horizontal plane HP. The first vane 136, unlike the first vane 36 of the one embodiment of the top end air compartment, is not fixedly welded or secured to the opposed side portions 144A, 144B of a mounting frame, generally designated in FIG. 7 as 142. Instead, a pivot pin 168 is fixedly mounted to each respective one of the opposed transverse edges 140A, 140B of the first vane 136. Each pivot pin is rotatably received in one of an engagement bore 170 in a respective one of the side portions 144A, 144B of the mounting frame 142 such that the first vane 136 is rotatable about a horizontal rotation axis RA transverse to the longitudinal extent of the channel portion of the another embodiment of the top end air compartment in which the mounting frame 142 is fixedly secured. A linkage sub-assembly 172 includes a plurality of link arms movably connected to one another. One of the link arms is movably connected to an adjustment control unit 174 for controlled adjustment of the orientation of the first vane 136 relative to the horizontal plane HP about the rotation axis RA.

The angle AC defined by the intersection of the first vane 136 and the horizontal plane HP is thereby variably adjustable via controlled movement of the linkage sub-assembly 172 by the adjustment control unit 174. The angle AC can range from about less than 5 degrees to more than 45 degrees and is preferably about 30 degrees. Thus, the movably adjusting means in the form of the linkage sub-assembly 172 and the adjustment control unit 174 is operable to adjustably move the first vane 136 between a first position in which longitudinally coextensive portions of the first vane 136 and the second vane 154 are generally parallel to one another and a second position in which longitudinally coextensive portions of the first vane 136 and the second vane 154 are not parallel to one another. In the another embodiment of the top end air compartment shown in FIGS. 5 and 6, a second vane 156 above the first vane 136 and a third vane 66 below the first vane 136 are non-movably or fixedly secured to the mounting frame 142 via, for example, welding of the respective vane to the side portions 144A, 144B.

Figure 7:
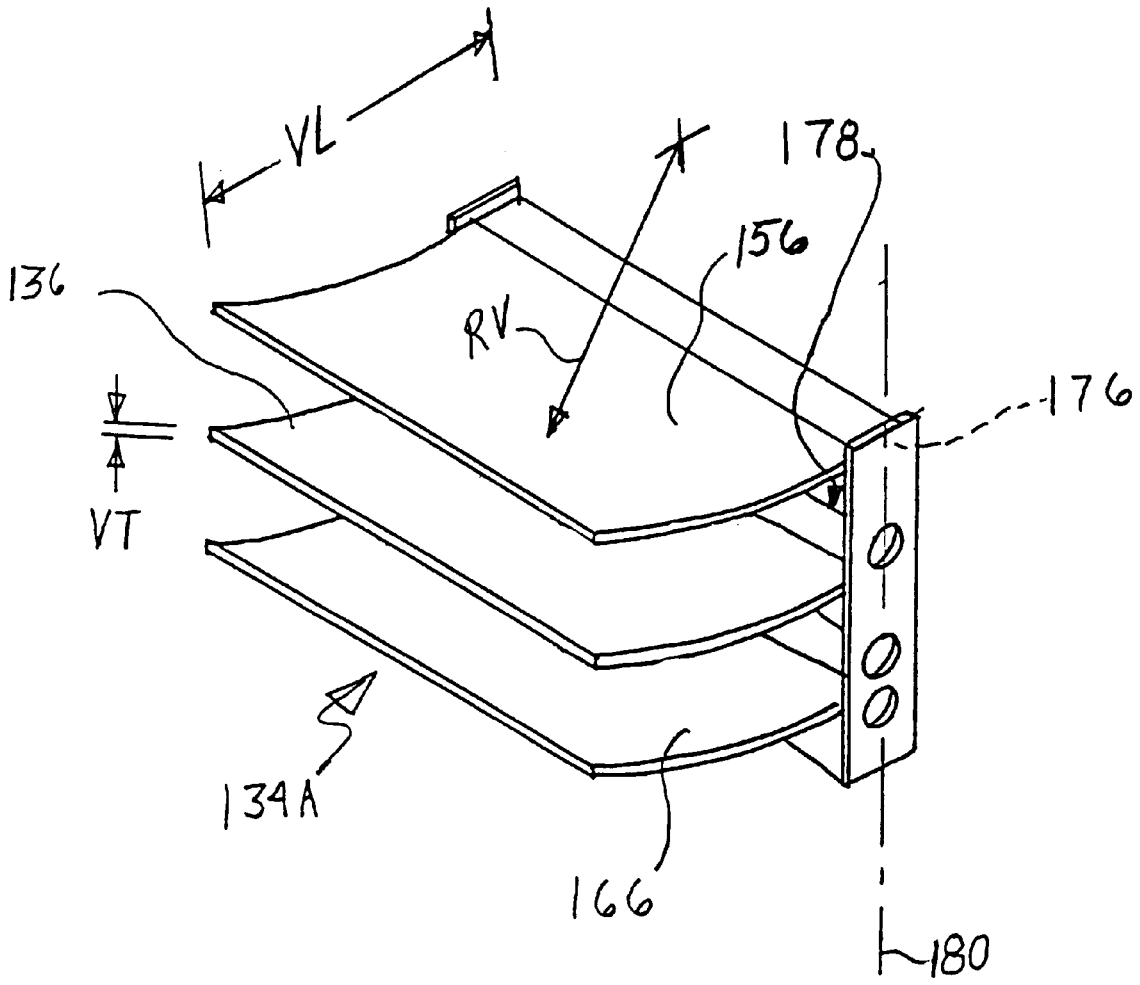
FIG. 7 is a schematic perspective view of a first variation of the another embodiment of the corner windbox air compartment shown in FIGS. 5 and 6.

Reference is now made to FIG. 7 which is a perspective view of a first variation of the exit assembly 134 of the another embodiment of the top end air compartment described with respect to FIGS. 5 and 6. This first variation of the exit assembly, which is hereinafter designated as the exit assembly 134A, may be installed solely in the top end air compartment, solely is any other individual air compartment, or in any selected combination of two or more of the air compartments. In the exit assembly 134, the upwardly oriented surface portion 160 of each of the three vanes—the first vane 136, the second vane 156, and the third vane 166—has an individually constant radius of curvature and, furthermore, the individual radius of curvature RS of each vane is set at the same value for all of the vanes. In other words, the upstream longitudinal extent 162A of each vane has the same predetermined radius of curvature RS as its downstream longitudinal extent 162B. The first vane 136 has a predetermined length VL, as viewed in the direction of air flow over the vane. Also, in this variation, the first vane 136 is mounted to the frame 142 at a mounting location 176 such that the lengthwise distance from the leading edge 178 of the first vane with respect to the direction of air flow to the vertical centerline 180 of the mounting location 176 is no greater than a value equal to one-third (⅓) of the predetermined vane length VL. Preferably, the lengthwise spacing of the leading edge 178 of the first vane 136 to the mounting location vertical centerline 180 is a value less than one-tenth (1/10) of the predetermined vane length VL.

Additionally, in the first variation of the exit assembly 134A illustrated in FIG. 7, at least the first vane 136 is preferably formed of a "thin" or "airfoil" shape which is to be understood as a shape in which the thickness VT of the first vane 136 is substantially much smaller than its vane length VL—i.e., on the order of about ten percent (10%) of its vane length VL. This shape facilitates the maintenance of the velocity and, even, the acceleration, of the air flowing around the vane by promoting the reduction of any pressure loss which may occur as the flowing air exits the chamber portion of the air compartment. Likewise, the leading edge 178 of the first vane 136 as well as the leading edges of the other vanes is preferably chamfered to promote the reduction of the pressure loss. The overall configuration of the exit assembly 134, including its individual features such as the "thin" or "airfoil" shape and the chamfered leading edges of the first vane 136 and the other vanes, permit the air compartment at which the exit assembly 134 is installed to introduce overfire air in a manner which promotes a longer residence time of fuel in the sub-stoichiometric conditions of the main burner zone of the furnace while at the same time minimizing the energy required to introduce such overfire air by relatively reducing airflow pressure loss so as to maximize the quantity of overfire air introduced through the air compartment for a given fan output.

Thus, in accordance with the present invention, there is provided an air compartment or air compartments for a corner windbox of a tangentially fired furnace which permits the introduction of overfire air in a manner which promotes a longer residence time of fuel in the sub-stoichiometric conditions of the main burner zone of the furnace while at the same time minimizing the energy required to accomplish an introduction of overfire air in this manner. For example, the air compartment of the present invention can be configured to introduce overfire air in a direction away from the direction in which fuel is introduced into the main burner zone of the furnace by the fuel nozzles in compartments below the air compartment of the present invention, thereby promoting a longer residence time of fuel in the sub-stoichiometric conditions of the main burner zone, while at the same time minimizing the energy required to introduce such overfire air by virtue of a configuration which relatively reduces the airflow pressure loss so as to maximize the quantity of overfire air introduced for a given fan output.

Moreover, there has been provided an air compartment or compartments for a furnace which advantageously increase the free area of the respective compartment while minimizing pressure drop in comparison to a conventional air compartment. These advantages are provided by vanes in the air compartment of the present invention which direct the flow of air exiting the air compartment while obstructing relatively less of the flow area than a conventional air compartment tip.

While various embodiments of the invention have been shown, it will be appreciated that modifications thereof, some of which have been alluded to hereinabove, may still be readily made thereto by those skilled in the art. It is, therefore, intended that the appended claims shall cover the modifications alluded to herein as well as all the other modifications which fall within the true spirit and scope of the present invention.

We claim:

1. In an air compartment of a corner windbox of a tangential firing system of a fossil fuel-fired furnace having a channel portion for the flow therethrough of air from an air delivery duct to an opening in the furnace, the channel portion having a longitudinal extent with an entrance end communicating with the air delivery duct and an exit end communicating with the furnace opening and having a generally parallelepiped cross sectional shape transverse to its longitudinal extent and being mounted in the corner windbox such that its longitudinal extent is parallel to a horizontal plane, an air compartment exit assembly comprising:

a first means for guiding an air stream at the exit end of the channel portion, the first air stream guiding means having a surface portion which intersects the horizontal plane at an acute angle, the first air stream guiding means having a pair of opposed transverse edges, and means for mounting the first air stream guiding means relative to the channel portion for guiding thereby of an air stream passing from the channel portion through the furnace opening into the furnace, the mounting means including a pair of opposed side portions and means for securing each opposed side portion interiorly of the channel portion on a respective side thereof, the first air stream guiding means extending between the pair of opposed side portions with each transverse edge of the first air stream guiding means being secured to a respective one of the opposed side portions of the mounting means and the mounting means and the first air stream guiding means being disposed within the channel portion such that the leading edge of the first air stream guiding means is upstream of the furnace opening.

2. In an air compartment, the air compartment exit assembly according to claim 1 wherein the mounting means includes an interconnecting portion secured to and extending transversely between the pair of opposed side portions at a vertical spacing from the first air stream guiding means.

3. In an air compartment, the air compartment exit assembly according to claim 2 and further comprising a second air stream guiding means having opposed transverse edges each secured to a respective one of the pair of opposed side portions of the mounting means such that the second air stream guiding means is secured to and extends between the opposed side portions of the mounting means at a disposition above the first air stream guiding means with longitudinally coextensive portions of the first and second air stream guiding means being generally parallel to one another.

4. In an air compartment, the air compartment exit assembly according to claim 3 wherein the upwardly oriented surface portion of the first air stream guiding means includes an upstream longitudinal extent having a predetermined radius of curvature and a downstream longitudinal extent having a predetermined radius of curvature different than the radius of curvature of the upstream longitudinal extent.

5. The top end air compartment according to claim 1 wherein the air compartment exit assembly includes a second air guiding means having opposed transverse edges each secured to a respective one of the pair of opposed side portions of the mounting means such that the second air stream guiding means is secured to and extends between the opposed side portions of the mounting means at a disposition above the first air stream guiding means with longitudinally coextensive portions of the first and second air stream guiding means being generally parallel to one another and support means extending vertically between and secured to the first and second air guiding means.

6. The top end air compartment according to claim 4 wherein the air compartment exit assembly includes support support means extending vertically between and secured to the fdirst and second air guiding means.

7. The top end air compartment according to claim 1 wherein the air compartment exit assembly includes a pair of sacrament pins each insertable through a throughbore respectively disposed in each of the opposed side portions of the air compartment exit assembly into engagement with an engagement bore respectively disposed in each side of the channel portion.

8. The top end air compartment according to claim 1 wherein the air compartment exit assembly includes a second air guiding means at a disposition above the first air stream guiding means and means for movably adjusting the orientation of the first air guiding means relative to the horizontal plane such that the first air guiding means can be adjustably moved between a first position in which longitudinally coextensive portions of the first and a second air stream guiding means are generally parallel to one another and a second position in which longitudinally coextensive portions of the first and second air stream guiding means are not parallel to one another.

9. In a air compartment of a corner windbox of a tangential firing system of a fossil fuel-fired furnace having a channel portion for the flow therethrough of air delivery duct to an opening in the furnace, the channel portion having a longitudinal extent with an entrance end communication with the furnace opening and having a generally parallelepiped cross sectional shape transverse to its longitudinal extent and being mounted in the corner windbox such that its longitudinal extent is parallel to a horizontal plane, an air compartment exit assembly comprising:

a first means for guiding an air stream at the exit end of the channel portion, the first air stream guiding means having a surface portion which intersect the horizontal plane at an acute angle, the first air stream guiding means having a pair of opposed transverse edges, and means for mounting the first air stream guiding means relative to the channel portion for guiding thereby of an air stream passing from the channel portion through the furnace opening into the furnace, the mounting means including a pair of opposed side portions and means for securing each opposed side portion interiorly of the channel portion on a respective side thereof, the first air stream guiding means extending between the pair of opposed side portion with each transverse edge of the first air stream guiding means being secured to a respective one of the opposed side portions of the mounting means and the mounting means and the first air stream guiding means being disposed within the channel portion such that the leading edge of the first air stream guiding means is upstream of the furnace opening.

10. In an air compartment, the air compartment exit assembly according to claim 9 wherein the mounting means includes an interconnecting portion secured to and extending transversely between the pair of opposed side portions at a vertical spacing from the first air stream guiding means.

11. In an air compartment, the air compartment exit assembly according to claim 10 and further comprising a second air stream guiding means having opposed transverse edges each secured to a respective one of the pair of opposed side portions of the mounting means such that the second air stream guiding means is secured to and extends between the opposed side portions of the mounting means at a disposition above the first air stream guiding means with longitudinally coextensive portions of the first and second air stream guiding means being generally parallel to one another.

12. In an air compartment, the air compartment exit assembly according to claim 11 wherein the upwardly oriented surface portion of the first air stream guiding means includes an upstream longitudinal extent having a predetermined radius of curvature and a downstream longitudinal extent having a predetermined radius of curvature different than the radius of curvature of the upstream longitudinal extent

* * * * *